US005341706A

United States Patent [19]

Takagi

[11] Patent Number: 5,341,706

[45] Date of Patent: Aug. 30, 1994

[54] SCREW-DRIVING DEVICE

[75] Inventor: Haruo Takagi, Tokyo, Japan

[73] Assignee: Toyo Techno Co., Ltd., Tokyo, Japan

[21] Appl. No.: 128,802

[22] Filed: Sep. 29, 1993

[30] Foreign Application Priority Data

Oct. 20, 1992 [JP] Japan ..... 4-281858
Jan. 26, 1993 [JP] Japan ..... 5-1671[U]

[51] Int. Cl.[5] ..... B25B 23/04
[52] U.S. Cl. ..... 81/434
[58] Field of Search ..... 81/57.37, 433, 434, 81/435, 431

[56] References Cited

U.S. PATENT DOCUMENTS 3,910,324 10/1975 Nasiatka ..... 81/434
4,059,034 11/1977 Hornung .
5,083,483 1/1992 Takagi ..... 81/434
5,167,174 12/1992 Fujiyama et al. ..... 81/434

*Primary Examiner*—D. S. Meislin

*Attorney, Agent, or Firm*—Kane, Dalismer, Sullivan, Kurucz, Levy, Eisele and Richard

[57] ABSTRACT

A screw-driving device, which can drive screws continuously one by one, comprises a casing coupled to a screwdriver, a slide member slidably moved in reciprocating movement in the casing and a mechanism for feeding a screw-holding tape by one-step pitches corresponding to the distances between the adjacent screws on the tape. The tape feeding mechanism includes a guide slot provided in the casing, and a two-arm lever pivotally connected to the slide member and pivotally moved to perform indexing of the screws to a position aligned with the screwdriver by a pin fitted into the inclined section of the guide slot. A pawl member with a pawl fitted into one of the grooves at one lateral edge of the tape is pivotally connected to the end of the other arm of the two-arm lever and is biased toward the tape by a spring. At the same time, a further pawl member entering one of the grooves at the opposite side of the tape is pivotally connected to the slide member and is biased toward the tape.

8 Claims, 11 Drawing Sheets

SCREW-DRIVING DEVICE

FIELD OF THE INVENTION

The present invention relates to a screw-driving device which is coupled to a screwdriver and which is adapted to continuously drive screws one by one which are held in a screw-holding tape in line.

BACKGROUND OF THE INVENTION

This type of screw-driving device comprises a tubular casing coupled to the front end of the screwdriver, a slide member slidably fitted into the casing through a return spring, and a mechanism provided within the slide member to feed a screw-holding tape by one-pitch steps corresponding to the intervals between the adjacent screws on the tape. In such a tape feeding mechanism, a pin is provided on one side surface of a sprocket having a number of projections on both side edges of the outer periphery thereof, and the pin is fitted into a guide slot provided on one side surface of the tubular casing and extending obliquely and then parallel relative to the longitudinal direction of the casing.

When the slide member is pressed against a workpiece, the slide member is forced into the casing and the pin is moved along the guide slot to thereby rotate the sprocket by one-pitch steps corresponding to the distance between the adjacent screws on the tape, so that the screw-holding tape having the grooves fitted onto the sprocket is fed by one pitch. However, after the screw on the screw-holding tape is driven into the workpiece by the screwdriver being rotated, the pin of the sprocket is returned through the rectilinear section of the guide slot by the return spring within the casing and, then, passed through the inclined section of the guide slot; therefore, the sprocket will be rotated in the opposite direction by one pitch and returned to the original position. For this purpose, a wide variety of complicated mechanisms have hitherto been used to disconnect the interlock between the sprocket and the guide slot near the end of the return stroke.

BRIEF SUMMARY OF THE INVENTION

An object of the invention is to provide a screw-driving device having a considerably simple mechanism for feeding a screw-holding tape by the step of one pitch.

According to one aspect of the present invention, there is provided a screw-driving device which is adapted to be coupled to a screwdriver and continuously drive screws held in a screw-holding tape in line one by one during a pressure stroke, which comprises:

a tubular casing coupled to said screwdriver;

a slide member slidably fitted for reciprocating movement in said casing;

a return spring means for returning said slide member to its initial extended position during a return stroke;

a mechanism provided in said slide member for feeding said screw-holding tape by the step of one pitch, corresponding to the distance between the adjacent screws on said tape, said screw-holding tape-feeding mechanism including:

a guide slot means provided in said casing;

a two-arm lever means having a pin fitted into said guide slot at the end of one arm of said two-arm lever and pivotally connected to said slide member;

a pawl member pivotally connected to the end of the other arm of said two-arm lever and engageable in one of grooves or apertures at one lateral edge of said screw-holding tape by a spring means; and a further pawl member pivotally connected to said slide member and engageable in one of further grooves or apertures at one lateral edge or the opposite lateral edge of the screw-holding tape by a spring means, said guide slot means including an inclined section which causes said two-arm lever means to be pivotally moved so that said pawl member of said two-arm lever is returned over said screw-holding tape held by said further pawl member by one pitch during said pressure stroke and feeds said screw-holding tape by one pitch during said return stroke.

In further accordance with the invention, there is provided a screw-driving device further comprising a mechanism provided in said slide member for pulling back said screw-holding tape in the direction opposite the tape feeding direction, said tape pulling-back mechanism including projections extending toward each other and provided on both said pawl member pivotally connected to said two-arm lever and said further pawl member pivotally connected to said slide member at the ends of both said pawl members away from the pawls thereof, and a two-arm lever pivotally connected to said slide member and adapted to engage said opposite projections for pulling back said pawls of both pawl members in the direction away from the groove or aperture of the screw-holding tape.

In further accordance with the invention, there is provided a screw-driving device further comprising a screw-holding mechanism provided in front of a tape guide passage of said slide member, said screw-holding mechanism including a pair of screw guide members slidably arranged opposite each other with the axis of said driver bit as a center and in a transverse through-hole of said slide member passed through transversely to the tape-feeding direction, spring means for biasing said screw guide members normally in such a direction as to be moved toward each other, and a means for moving said pair of screw guide members toward and away from each other at the time of driving the screws and at the time of feeding the tape, respectively, while being linked to the movement of the screw-holding tape by the step of one pitch.

According to a further aspect of the invention, there is provided a screw-driving device further comprising a tape-holding means provided on the back portion of the side of said casing at the side of said slide member provided with a tape-inserting opening, said tape-holding means including a mount secured to the back portion of said casing and a tape-holding member pivotably supported by a pivotal shaft secured to said mount in a parallel manner to the plane of said casing, said tape holding member being supported on said pivotal shaft so that the guide groove thereof is obliquely inclined upwardly toward the tape-inserting opening of said slide member.

BRIEF DESCRIPTION OF THE DRAWINGS

These and other objects, features and advantages of the invention will become more apparent upon a reading of the following detailed specification and drawings, in which.

DESCRIPTION OF THE PREFERRED EMBODIMENTS

Figure 1:
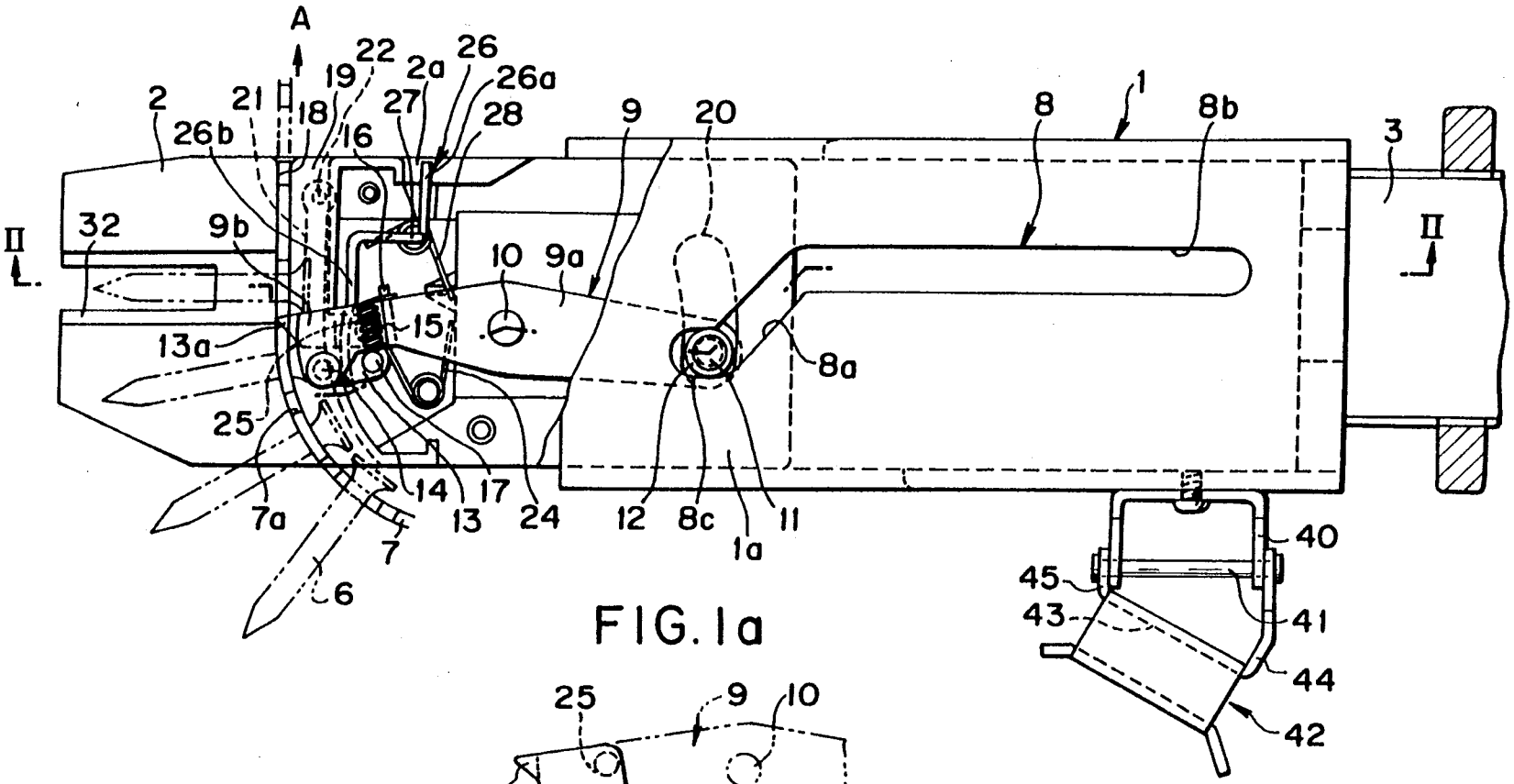
FIG. 1 is a side view showing a first embodiment of a screw-driving device according to the present invention, with parts partially broken away, and with the position where indexing of a screw is completed (the driving operation is commenced).

Now, the invention will be explained in detail by way of embodiments shown in the drawings.

Figure 2:
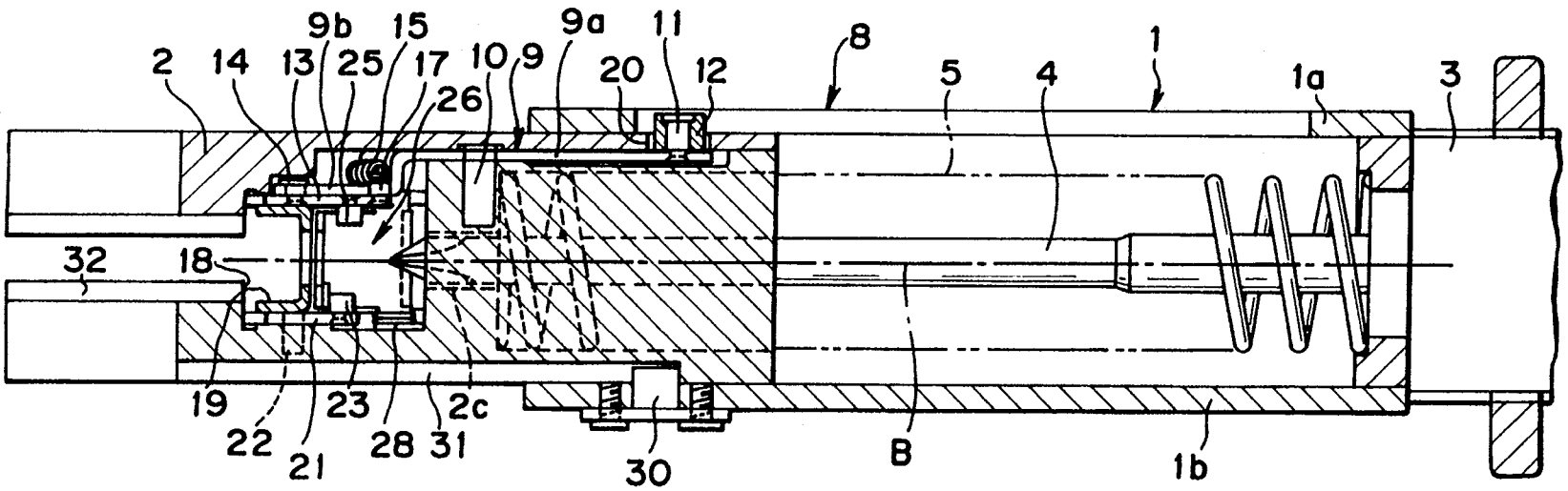
FIG. 2 is a longitudinal sectional view taken along Line II—II in FIG. 1.
Figure 3:
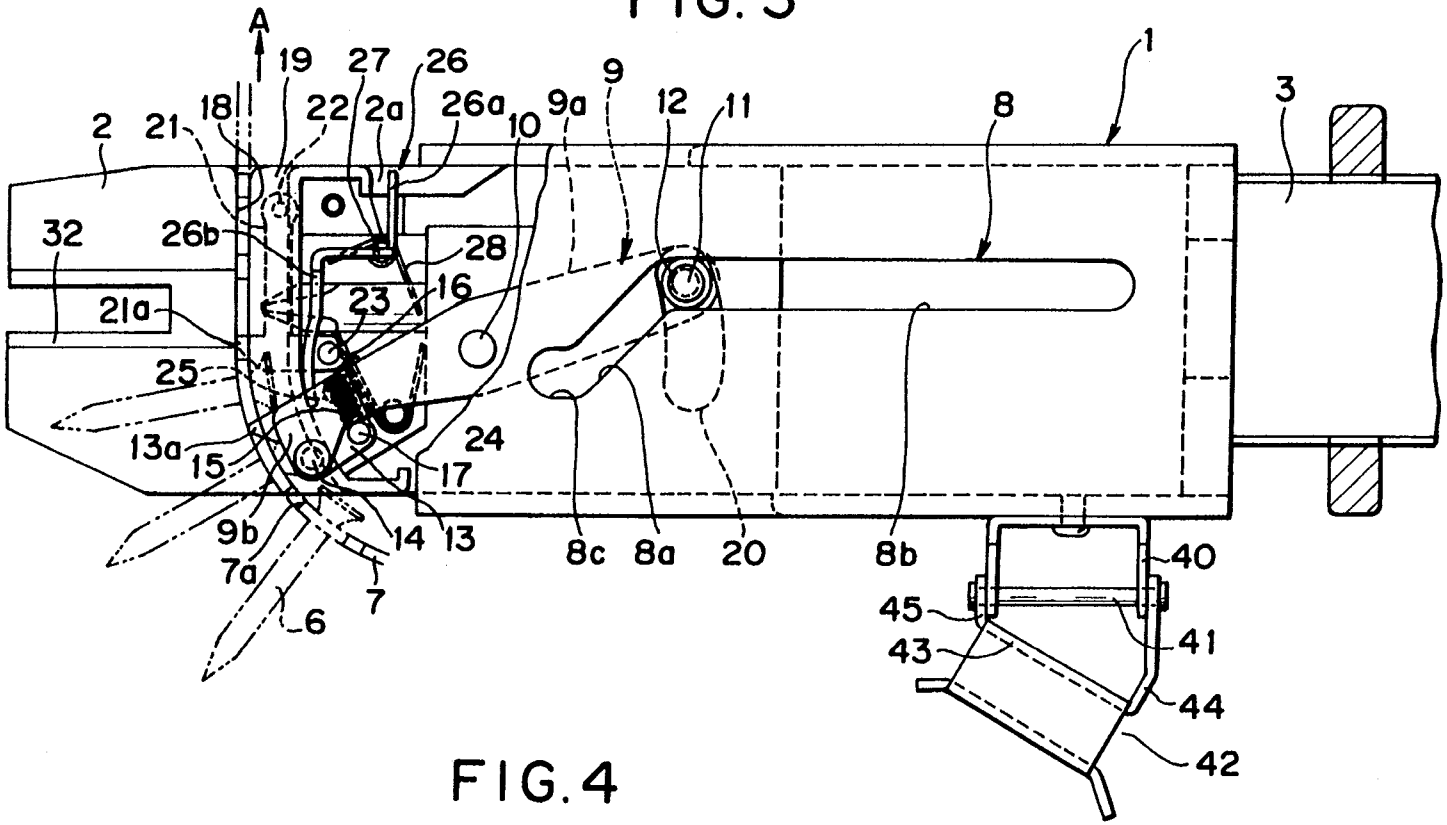
FIG. 3 is a side view similar to FIG. 1, showing the device with the position where indexing of a screw is commenced during the return stroke.

Referring to FIGS. 1 to 3, a screw-driving device according to the invention comprises a tubular casing 1 and a slide member 2 slidably fitted into the casing 1. In using the screw-driving device, a cylinder part 3 extending out of the back end of the casing 1 is connected to a screwdriver. As shown in FIG. 2, a driver bit 4 at the front end of the screwdriver enters into a through-hole 2*c* within the slide member 2, which is normally energized forwardly by a return spring 5.

In FIGS. 1 to 3, according to the invention, the slide member 2 is provided therein with a mechanism for feeding a screw-holding tape 7, on which screws 6 are held in line at equal intervals, by one-step pitches corresponding to the distances between the adjacent screws.

Figure 4:
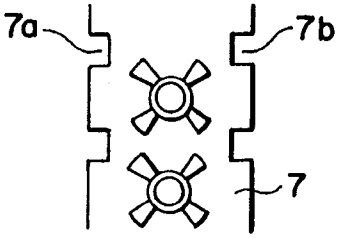
FIG. 4 is a fragmentary plan view showing an example of a screw-holding tape having grooves opening outwardly along both lateral edges thereof.

As the screw-holding tape, two types can be used, one having grooves 7*a* and 7*b* opening outwardly along both lateral edges of the tape at a constant pitch, as shown in FIG. 4, and the other having apertures along both lateral edges of the tape at a constant pitch (not shown).

Figure 1A:
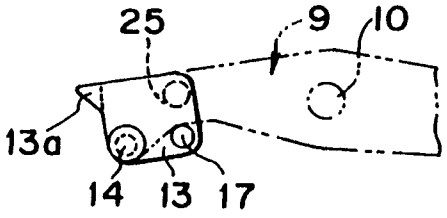
FIG. 1*a* is a fragmentary view of a pawl member pivotally secured to a two-arm lever.

The mechanism for feeding the screw-holding tape includes a guide slot 8 for a pin described later and provided to pass through one side wall 1*a* of the casing 1, as shown in FIG. 1. The guide slot 8 comprises a rectilinear section 8*b* extending longitudinally along the casing; an inclined section 8*a* inclined downwardly and forwardly with respect to the rectlinear section 8*b*, and a short rectlinear section 8*c* extending longitudinally along the casing 1 and in front of the inclined section 8*a* in a continuous manner therewith. On the other hand, a two-arm lever 9 is pivotally connected by a pin 10 at one side parallel to the axis B of the driver bit 4 within the slide member 2, as viewed in the sectional plan view of FIG. 2, and a cylinder member 12, which is rotatably fitted onto the pin 11 provided at the end of one arm 9*a* of the two-arm lever 9, is fitted into the short rectlinear section 8*c* (FIG. 1) of the guide slot 8 of the casing 1. Accordingly, even when a screw-holding tape 7 extending out of the slide member 2 is pulled suddenly in either direction, the two-arm lever 9 which engages with the screw-holding tape 7 through a pawl 13*a* of a pawl member 13 (FIG. 1*a*) can not be pivotally moved, so that the screw 6 at the position where indexing of the screw has been completed is not forced out by the driver bit 4, and, therefore, safety is ensured. A plate-like pawl member 13 is pivotally connected to the front end of the other arm 9*b* of the two-arm lever 9 for pivotal motion about a pin 14 and is energized toward the screw-holding tape 7 by a spring 15, which, as apparent from FIG. 1, is hooked at one end to a projection 16 on the side wall of the pawl member 13 and at the other end to a projection 17 provided on the pawl member 13. The pawl 13*a*of the pawl member 13 is normally energized by the spring 15 to thereby be inserted into one of the grooves 7*a* (FIG. 4) provided at one lateral edge of the screw-holding tape 7 at equal pitches. The screw-holding tape 7 is guided through the guide passage, which is defined by a screw-holding tape guiding wall 18 vertically passed through the slide member 2 transversely to the longitudinal direction thereof in FIG. 1 and by a screw-holding tape guiding member 19 of a channel-shaped cross-section (FIG. 2) secured to the slide member 2 opposite the screw-holding tape guide wall 18. Further, the cylinder member 12 at the end of one arm 9*a* of the two-arm lever 9 is passed through the circular arc-like slot 20 in the side wall of the slide member 2 and extends into the guide slot 8 of the casing 1, as shown in FIG. 2.

In the maximum extended position of the slide member 2, as shown in FIG. 2, a stopper 30 secured to the front end portion of the casing 1 on the side surface 1*b* opposite the guide slot 8 so as to extend inwardly of the casing 1 is brought into abutting engagement with the inner end of a slot 31 extending longitudinally of the slide member 2 biased by the spring 5.

In a pressure stroke where the slide member 2 is to be pressed into the casing 1, the cylinder member 12 in the completed position of indexing shown in FIG. 1 is slightly moved backwards along the short rectilinear section 8*c* of the guide slot 8 of the casing 1, and then, obliquely and upwardly along the inclined section 8*a*, so that one arm 9*a* of the two-arm lever 9 is pivotally moved about the pin 10 counterclockwise while the other arm 9*b* is pivotally moved downwardly, to thereby return the pawl 13*a* of the pawl member 13 downwardly by one pitch corresponding to the distance between the adjacent screws on the tape. In this case, the pawl 13*a* of the pawl member 13 is pushed back from the groove 7*a* at one of the lateral edges of the screw-holding tape 7 against the biasing force of the spring 15 and is returned to the position shown in FIG. 3 sliding over the screw-holding tape 7. In order to prevent the screw-holding tape 9 from being returned together with the pawl 13*a* during the pressure stroke, a further T-shaped pawl member 21 (shown by the dotted lines in FIGS. 1 and 3) is pivotally connected by a pin 22 at the side opposite the pawl member 13 parallel to the axis B of the driver bit 4, as viewed in the plan sectional view of FIG. 2. The pawl member 21 is normally biased toward the screw-holding tape 7 by a torsion spring 24 which engages at one end thereof the inner wall of the slide member 2 and at the other end a projection 23 provided on the lower horizontal portion of the pawl member 21 at the end opposite the pawl 21*a* (FIG. 3), so that the pawl 21*a* at the front end of the pawl member 21 is brought into engagement with the groove 7*b* (FIG. 4) at the other lateral edge of the screw-holding tape 7. In a portion of the end of the return stroke (FIG. 3), the pawl member 13 of the other arm 9*b* of the two-arm lever 9 is forcibly pushed up by the inclined section 8*a* of the guide slot of the casing 1, and, at that time, the pawl 13*a* of the pawl member 13 pushes the screw-holding tape 7 up by one-step pitch corresponding to the distance between the adjacent screws on the tape until the tape is restored to the position where indexing of the screw is completed and it is aligned with the axis B of the driver bit 4, as shown in FIG. 1.

In this embodiment, the further pawl member 21 is provided at the side opposite the space from the pawl member 13; however, these pawl members may be provided at the same side if they can be arranged so as not to interfere with each other. In this case, the grooves or apertures in which the pawls of both pawl members engage must be provided along the same lateral edge of the screw-holding tape 7, with the pitches thereof being offset from each other.

Moreover, according to the invention, a screw guide mechanism is provided in front of the tape guide passage 18, 19 in the slide member 2. Referring to FIGS. 8 to 11, the screw guide member includes a pair of screw guide members 130, 130 in a transverse through-hole 2*b* passing through the slide member 2 transversely to the tape feeding direction A. The pair of screw guide members 130, 130 are slidably fitted into the transverse through-hole 2*b* in an opposite manner in terms of the extended line of the driver bit axis B (FIG. 2) as a center, that is, the threaded portion of the screw 6 held on the screw-holding tape 7. The pair of screw guide members 130, 130 is provided at the front end portion thereof with recesses 131, 131 having the depthes corresponding to the radius of the threaded portion to be guided, respectively, and at the rear end portion with recesses 132, 132 each defining a half cylindrical portion having a larger radius to facilitate the screw to enter thereinto.

Further, the screw guide mechanism is provided with a means for moving the pair of screw guide members 130, 130 toward and away from each other at the time of driving the screw and at the time of feeding the tape, respectively, while being linked to the feed of the screw-holding tape 7. The embodiment of the screw guide mechanism shown in FIGS. 8 to 11 is applied to the case where the tape 7 has the grooves 7*a* and 7*b* opening outwardly along both lateral edges thereof at equal pitches, as shown in FIG. 4. Tape-linked levers 133, 133 of channel-shaped cross-sections are pivotally connected to the screw guide members 130, 130 at pins 130*a*, 130*a*. Each of the tape linked-levers 133, 133 is extended from the screw-holding center line C—C of the screw guide members along the tape feeding direction A and is pivotally connected at the other end thereof to the recess of the slide member 2 by pins 134, 134, and the tape-linked levers 133, 133, or the pair of screw guide members 130, 130 pivotally connected thereto are normally biased toward the threaded portion of the screw 6 on the tape 7 by means of torsion springs 135, 135.

In the middle of the tape-linked levers 133, 133 are provided V-shaped projections 136, 136, which are each at a position offset by half the one pitch of the adjacent grooves of the tape from the center line C—C of the screw guide members 130, 130 in the tape feeding direction A, so that the V-shaped projections come to fit into the grooves at both lateral edges of the screw-holding tape 7 when the pair of screw guide members 130, 130 have engaged with each other. Practically, the V-shaped projection 136 is formed at the end of the projection extending from one of the lateral plates of the lever 133 to the tape 7, as is apparent from FIG. 8.

Figure 9:
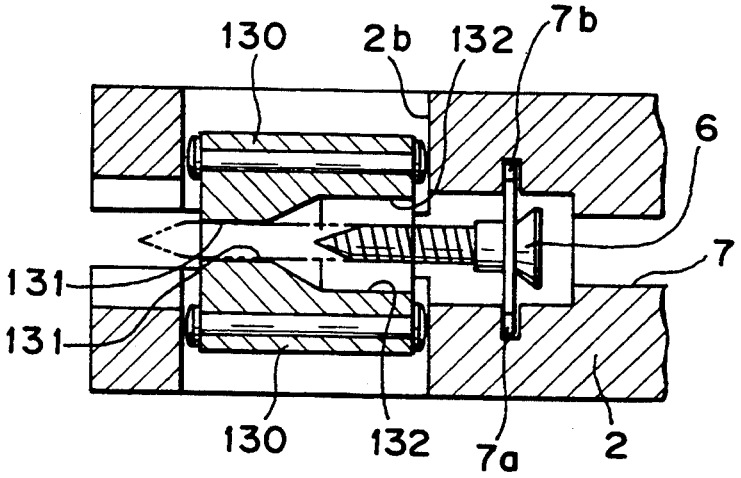
FIG. 9 is a sectional view taken along Line IX—IX in FIG. 8.
Figure 10:
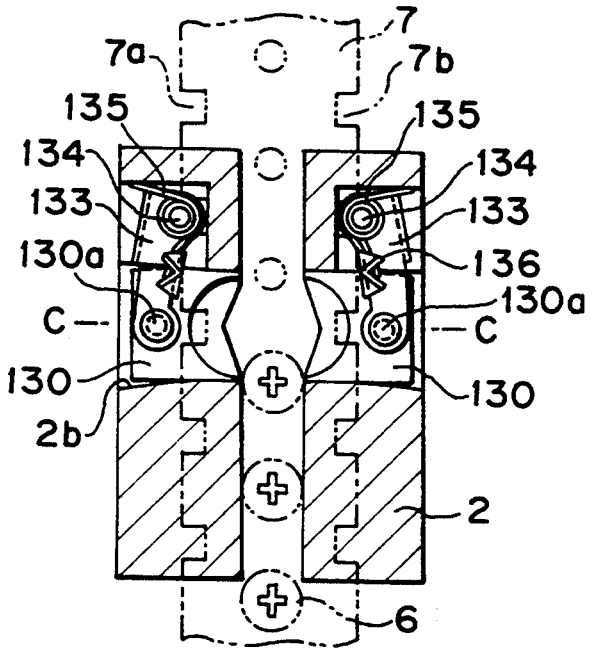
FIG. 10 is a sectional view taken along Line X—X in FIG. 8, showing the guide mechanism with screw guide members being away from each other during transference of the tape.
Figure 11:
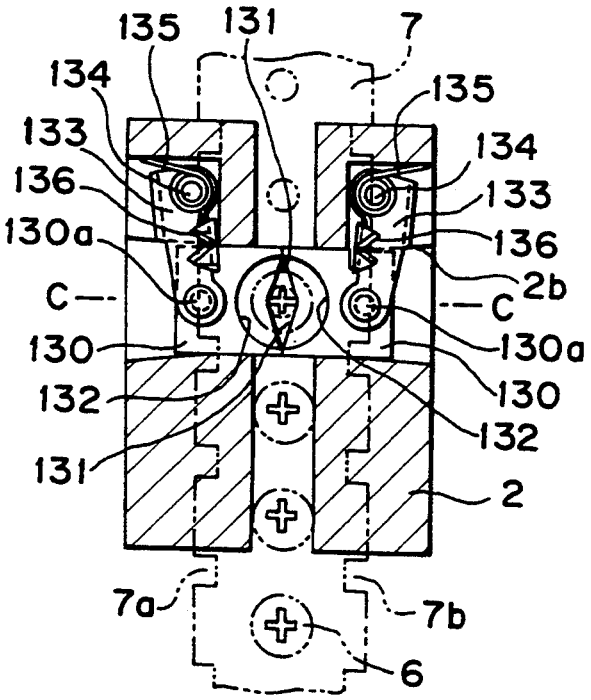
FIG. 11 is a sectional view taken along Line XI—XI in FIG. 8, showing the guide mechanism with the screw being held by the screw guide members after the tape has been transferred by one pitch.

When the slide member 2 which has been pushed into the casing 1 is forced back out of the casing 1 by the spring 5 so that the tape 7 is fed by one pitch by the inclined section 8*a* of the guide slot 8 of the casing 1 and the screw is on the same axis B as the driver bit 4 (FIGS. 6, 10 and 11), the V-shaped projections 136, 136 of the tape-linked levers 133, 133 engage the grooves 7*a* and 7*b* at both lateral edges of the tape 7 with the springs 135, 135, and the screw guide members 130, 130 engage with each other, thereby allowing such a long screw as shown by the two-dot chain line in FIG. 9 to be held. However, during the process of the tape 7 being fed by one pitch corresponding to the distance between the adjacent screws on the tape, the V-shaped projections 136, 136 are pushed out of the grooves 7*a*, 7*b* at both lateral edges of the tape 7 being moved, while sliding over the outer edges of the tape, as shown in FIG. 10, so that the screw held on the tape can easily be passed between the extended two screw guide members 130, 130.

Figure 12:
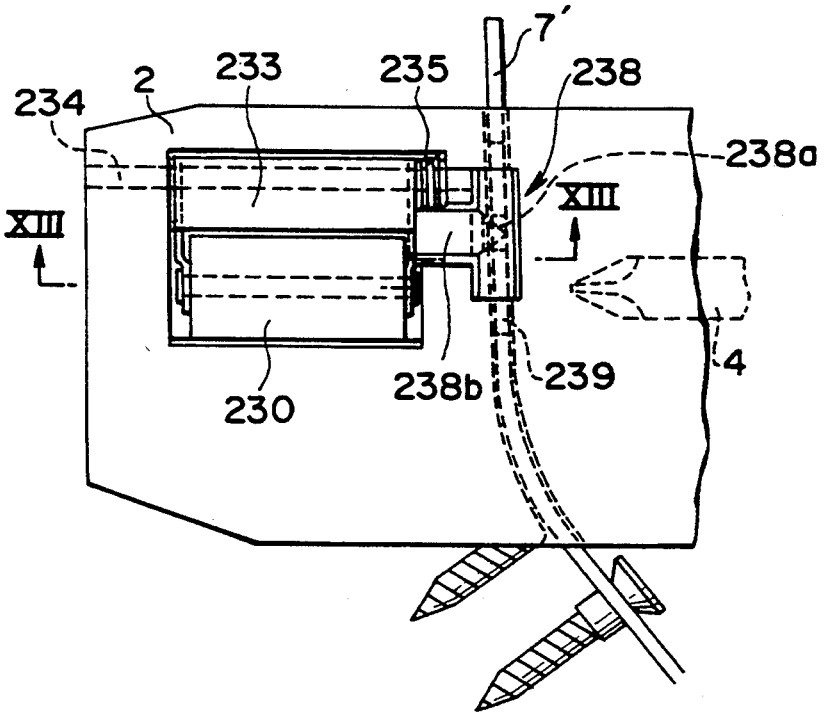
FIG. 12 is a fragmentary side view of the slide member provided with a second embodiment of the screw guide mechanism according to the invention.

In the embodiment of the above-mentioned screw guide mechanism, the case where the tape has the grooves 7*a* and 7*b* opening outwardly at equal pitches along both lateral edges of the tape, as shown in FIG. 4, has been explained. Another embodiment of the screw guide mechanism, that is, the case where the tape 7 has apertures along both lateral edges at equal pitches, as shown in FIG. 12, with referrence to FIGS. 12 to 16, will now be explained.

Figure 14:
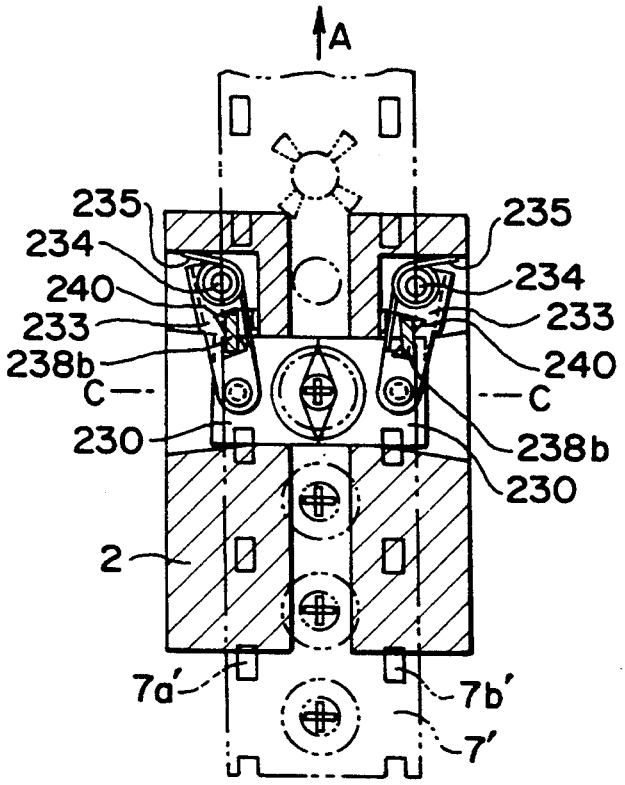
FIG. 14 is a fragmentary sectional view taken along Line XIV—XIV in FIG. 13, showing the guide mechanism with the screw guide members being similarly closed.
Figure 15:
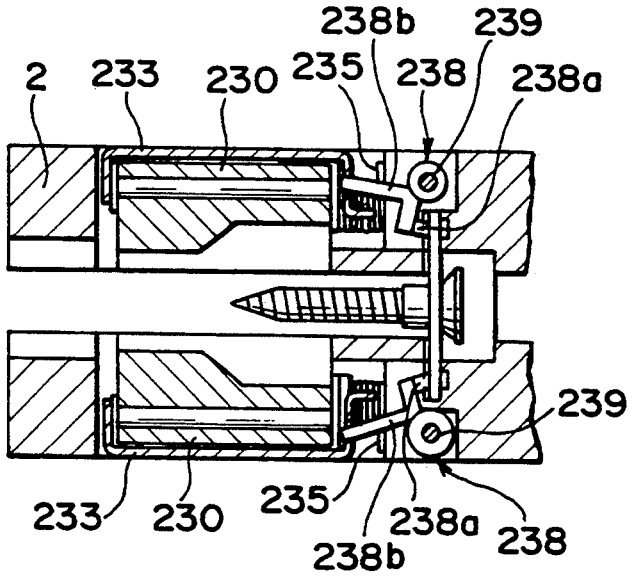
FIG. 15 is a fragmentary sectional view similar to FIG. 13, showing the guide mechanism with the screw members being opened.
Figure 16:
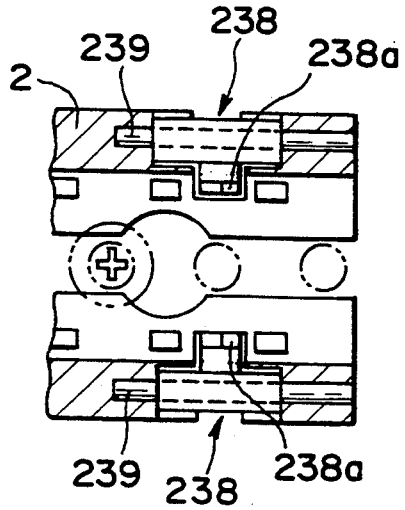
FIG. 16 is a fragmentary sectional view taken along Line XVI—XVI in FIG. 13.

In this case, a means for moving a pair of screw guide members 230, 230 toward and away from each other when driving the screw and when feeding the tape, respectively, while being linked to the feed of the screw-holding tape 7′, includes channel-shaped levers 233, 233 pivotally connected at one end thereof to the pair of screw guide members 230, 230 so as to place each of them between the levers. Each of the levers 233, 233 is extended from the screw-holding center line C—C of the screw-holding member 230 along the tape feeding direction A and is connected at the other end to the recess of the slide member 2 by a pin 234. To the slide member 2 outside both lateral edges of the tape are pivotally connected two-arm levers 238, 238, which are to be linked to the tape, by pins 239, 239, and the ends of one of the arms 238*a*, 238*a* of the two-arm levers are extended so as to be able to fit into and out of the apertures in the direction perpendicular to the surface of the tape, and the ends of the other arms 238*b*, 238*b* are fitted into drive slots 240, 240 provided on one of the side surfaces of the screw guide member-holding levers 233, 233 (FIG. 14). The end of the arm 238*a* of each of the tape-linked two-arm levers is V-shaped (dotted line in FIG. 12), and is at the position offset from the screw-holding center line C—C of the screw holding members 230, 230 by half the one pitch corresponding to the distance between the adjacent apertures on the tape so as to fit perpendicularly into the apertures 7*a*' and 7*b*' when the pair of screw guide members 230, 230 engage each other.

Figure 13:
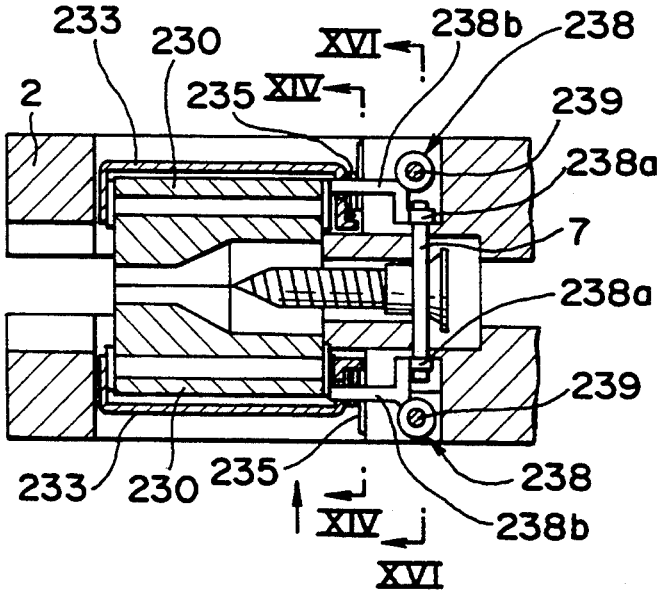
FIG. 13 is a fragmentary sectional view taken along Line XIII—XIII in FIG. 12, showing the guide mechanism with the screw guide members being engaged with each other and closed.

When driving the screw, the screw guide members 230, 230 engage with each other, as shown in FIGS. 13 and 14, and the ends of one of the arms 238*a*, 238*a* of the tape-linked two-arm levers fit into the apertures at both lateral edges of the tape. While the tape is being fed by one pitch, the V-shaped ends of one of the arms 238*a*, 238*a* of the tape-linked two-arm levers 238, 238 are pushed out of the apertures of the tape sliding over the tape, and accordingly, the tape-linked two-arm levers 238, 238 are pivotally moved outwardly to thereby open the screw guide members 230.

This embodiment, where the tape has no grooves at either of the lateral edges thereof which open outwardly, is advantageous in that, as the tape is passed through the tape guide passage and a tape holding means as described later, there is no danger of the tape being caught by such means.

This screw guide mechanism enables the long screws as shown in FIG. 9, which could have not been used in the prior art screw-driving device because of the short distance between the front end of the slide member and the tape, to be held by the recesses 31, 31 at the front end of the screw guide members so that the axis of the screw, when driven, is not offset transversely, thereby allowing the long screw to be driven precisely into a predetermined position in spite of the long screw. Simultaneously, the short screw as shown by the full line in FIG. 9 can be used as before, since it is not offset transversely even if there is no guide.

Further, the slide member 2 is provided with a mechanism for freely pulling back the screw-holding tape 7 in the direction opposite the tape feeding direction A (FIGS. 1 and 3). In addition to the above-mentioned projection 23 (FIGS. 2 and 3) provided at the end opposite the pawl 21*a* of the further T-shaped pawl member 21, the pulling-back mechanism includes a projection 25 (FIGS. 2 and 3) provided at the end opposite the pawl 13*a* of the pawl member 13 and extending inwardly. Particularly referring to FIG. 3, a further two-arm lever 26 is pivotally connected at a pin 27 to the interior of the slide member 2, one arm 26*a* of the other two-arm lever 26 extending into the opening 2*a* on the upper surface of the slide member 2 and the other arm 26*b* extending forwardly of the respective projections 25 and 23 of both pawl members 13 and 21 with a slight distance left between it and the pawls. The other arm 26*b* is normally biased to be brought into abutting engagement with the back surface of the tape guide member 19 by a torsion spring 28 wound around the pin 27. With the construction of this pawl pulling-back mechanism, when the front end of the one arm 26*a* of the two-arm lever 26 which exists in the opening 2*a* is pressed forward, the other arm 26*b* is pivotally moved backwardly about the pin 27 until it pushes the projections 23 and 25 of both pawl members 13 and 21, so that the pawls 13*a* and 21*a* disengage the grooves 7*a* and 7*b* at both lateral edges of the screw-holding tape 7, respectively. Accordingly, the screw-holding tape 7 can be freely pulled back. This allows the screws to be replaced by different screws midway during the screw-driving operation, and further allows any screws which have been fed by mistake to be returned to the condition where the screws are to be driven.

Figure 17:
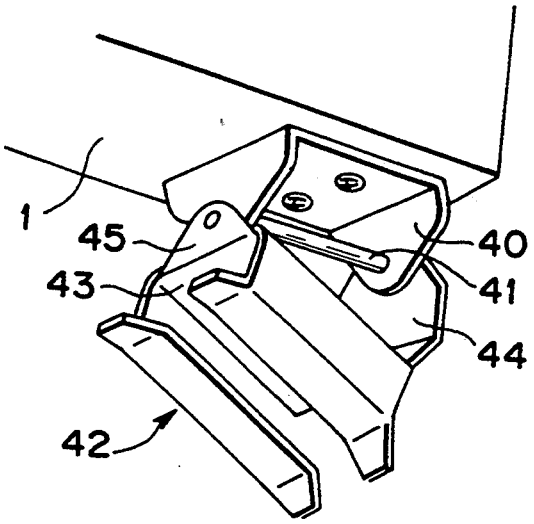
FIG. 17 is a perspective view of a tape-holding device according to the invention.

Moreover, the casing 1 is provided with a tape holding device at the back portion of the side surface corresponding to a tape inserting side. Referring to FIGS. 1, 3 and 17, the tape-holding device comprises a mount 40 attached to the back portion of the casing 1, and a tape-holding member 42 supported on the mount 40 for pivotal motion about a shaft 41 parallel to the plane of the casing 1. The tape holding member 42 has a guide groove 43 for holding the tape, and the guide groove 43 is supported by the shaft 41 so that it is inclined obliquely and upwardly toward the tape-inserting opening of the slide member 2 at the front of the casing 1, as is apparent from FIGS. 1, 3 and 17.

With this tape-holding device, the tape-holding member 42 is supported at the front end by a short leg 45 and at the back end by a long leg 44, and therefore, has a different radius of pivotal motion at the two ends. Accordingly, during pivotal motion of the tape-holding member 42, the front end of the guide groove 43 describes the path of a small circular arc, and simultaneously, the back end thereof describes the path of a great circular arc, thereby enlarging the range of angle of pivotal motion to guide the tape and smoothly feed the tape.

Next, a second embodiment of the present invention is explained with reference to FIGS. 5 to 7. In the drawing, the same reference characters are affixed to the parts similar to those in the first embodiment, and the explanation thereof is omitted, only the different points being explained.

Figure 5:
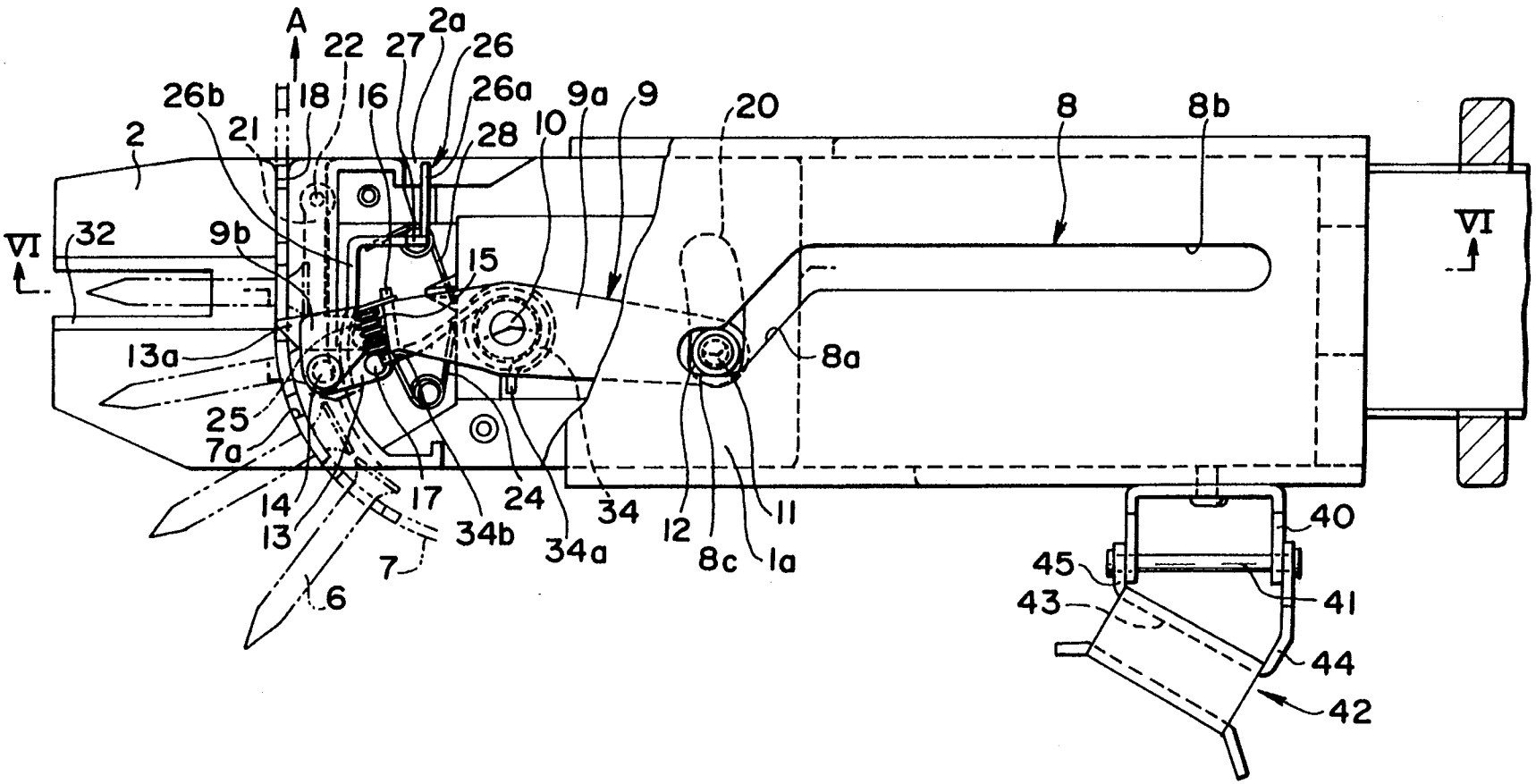
FIG. 5 is a side view showing a second embodiment of a screw-driving device according to the invention, with parts partially broken away, and with the position where indexing of the screw is completed (the driving operation is commenced).
Figure 6:
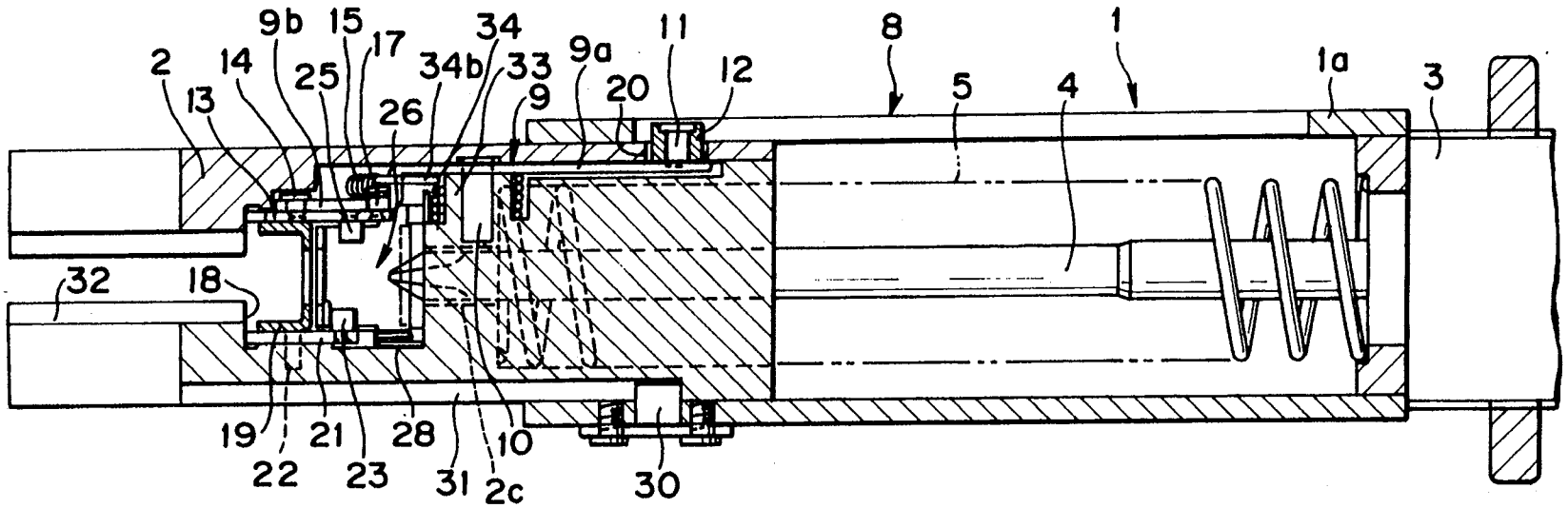
FIG. 6 is a longitudinal sectional view taken along Line VI—VI in FIG. 5.
Figure 7:
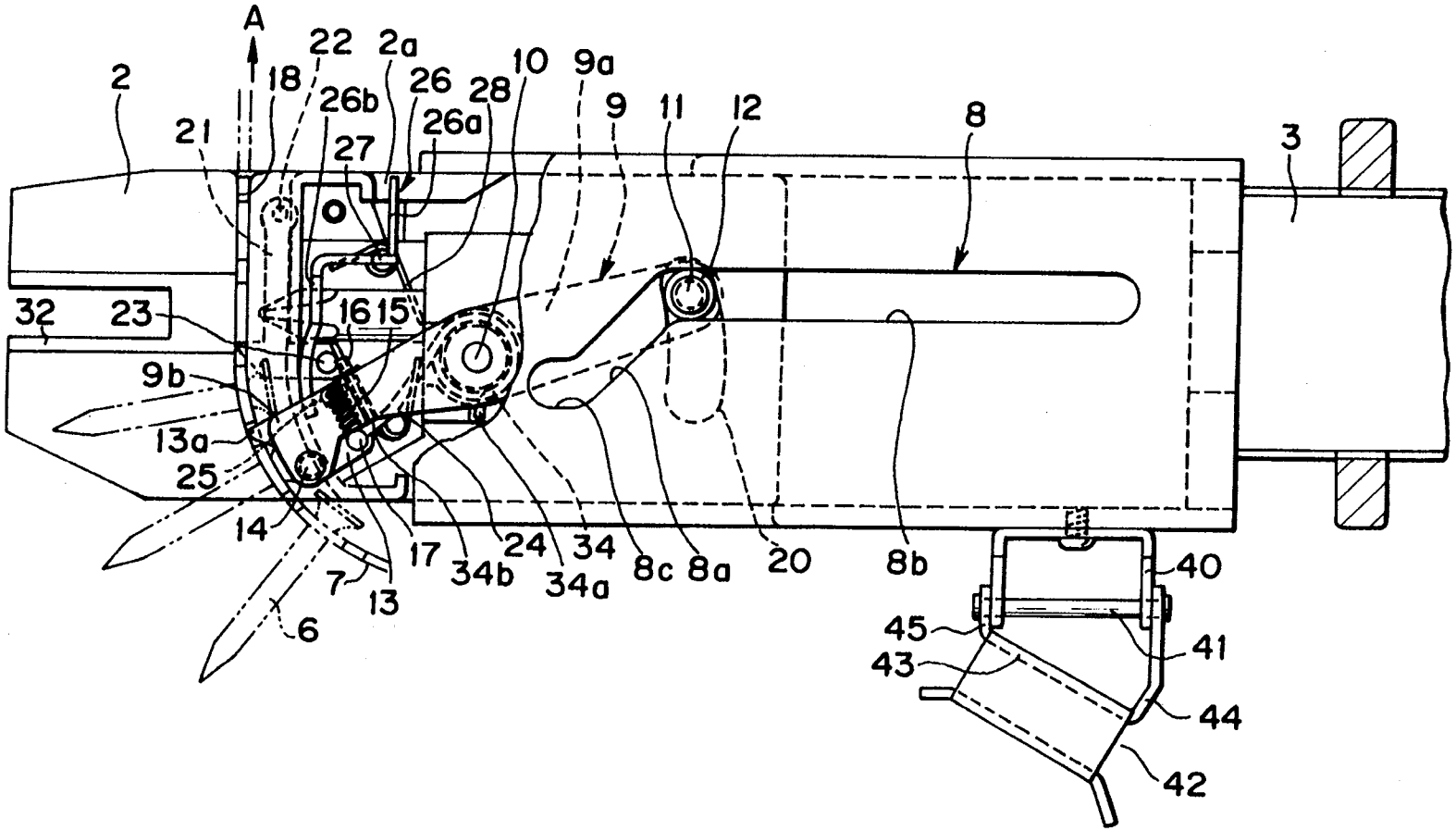
FIG. 7 is a side view similar to FIG. 5, showing the device with the position where indexing of the screw is commenced during the return stroke.
Figure 8:
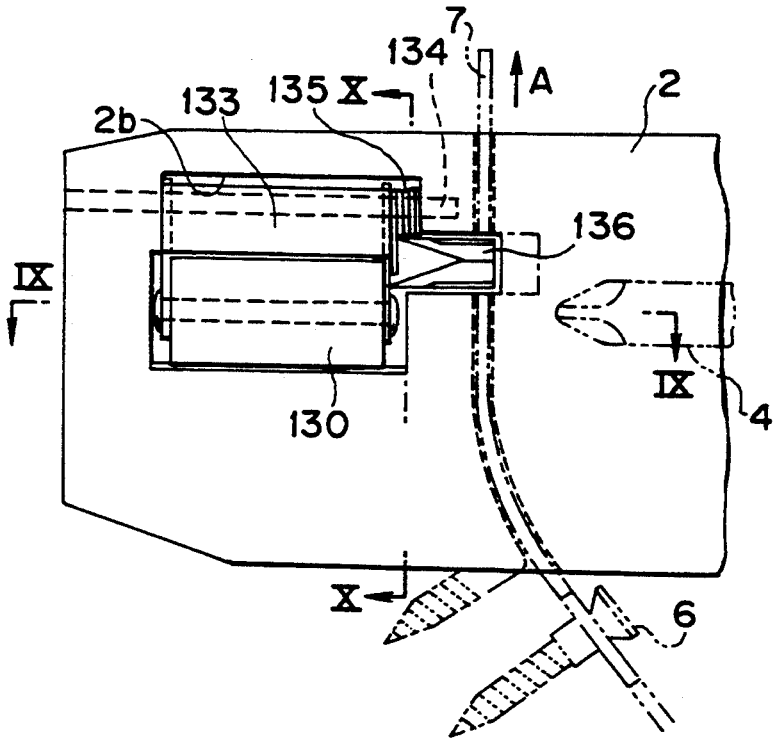
FIG. 8 is a fragmentary side view of a slide member having a first embodiment of a screw guide mechanism according to the invention.

In a screw-driving device according the second embodiment, as is apparent from FIGS. 5 and 6, an auxially torsion spring 34 is provided around the outer periphery of a cylinder portion 33 enclosing a pin 10 in the center of the pivotal motion of the two-arm lever 9 in the slide member 2. One end 34*a* of the auxially torsion spring 34 is in abutting engagement with a recess of the slide member 2, as shown in FIG. 5, and the other end 34*b* thereof is in abutting engagement with the stepped portion of the other arm 9*b* of the two-arm lever 9, as is apparent from FIGS. 5 and 6, so that the two-arm lever 9 is normally biased clockwise. Consequently, even when the screw-holding tape 7 has suddenly been pulled down by an external force in the position of stoppage in FIG. 5 where indexing of the screw is completed, such a sudden pivotal motion of the two-arm lever 9 during a stoppage of the device can be more surely prevented than in the first embodiment, since the two-arm lever 9 is normally in abutting engagement with the guide wall of the short rectilinear section 8*c* of the guide slot 8 by the force of the auxiliary spring 34 actuating through the pawl 13*a* of the pawl member 13 in the direction opposite that of the external force.

Now, operation of the screw-driving device of the first embodiment according to the invention will be briefly explained. When the front end of the slide member 2 is pressed against the member or workpiece into which screws are to be driven, the cylinder member 12 around the pin 11 of the two-arm lever 9 is moved back along the short rectilinear section 8*c* of the guide slot 8 of the casing 1, and then, the two-arm lever 9 is pivotally moved counterclockwise as viewed in FIG. 1 by the inclined section 8*a*, while the pawl 13*a* is pushed out of the groove 7*a* or aperture at one lateral edge of the tape against the force of the spring 15 and is moved down, sliding over the screw-holding tape 7, until it comes to fit into the following groove or aperture of the tape again after movement of the screw-holding tape by the step of one pitch. During such a downward movement of the pawl 13*a*, the pawl 21*a* of the other pawl member 21 remains engaged with the groove 7*b* (FIG. 4) or aperture at the lateral edge opposite the one lateral edge of the tape by the biasing force of the spring 24, so that the tape can not be returned and maintains its position. When the slide member 2 is further pressed while the cylinder member 12 of the two-arm lever 9 is moved along the rectilinear section 8*b* of the guide slot 8, the front end of the driver bit 4 is passed through the through-hole 2*c* (FIG. 2) of the slide member 2 and engages the head of the screw 6, thereby driving the screw 6 into the workpiece by the driver bit 4 driven in rotation by a screwdriver. In a return stroke, the cylinder member 12 of the two-arm lever 9 is moved back passing through the rectilinear section 8*b* by the return spring 5 and comes to the position shown in FIG. 3. Then, when the cylinder member 12 enters the inclined section 8*a*, the two-arm lever 9 begins to be pivotally moved clockwise and the tape 7 is fed by one pitch in the direction A by the pawl 13*a* of the pawl member 13 of the other arm 9*b*, which engages the tape 7, and comes to the position shown in FIG. 1. During such a feed of the tape, the pawl 21*a* of the further pawl member 21 is pushed out of the groove 7*b* or aperture against the spring 24 and slides over the tape 7 being fed by one pitch until the pawl 21*a* fits into the following groove 7*b* or aperture of the tape again.

The screw-holding tape-feeding mechanism as set forth in claim 1 is considerably simple in construction and cheap to produce.

With the construction as set forth in claim 2, even when the screw-holding tape extending out of the screw-driving device is suddenly pulled, the two-arm lever engaging the screw-holding tape through the pawl of the pawl member can not be pivotally moved, and therefore, a danger of the screw, which is already at the indexed position, being pushed out by the driver bit at the end of the screwdriver can be avoided.

With the construction as set forth in claim 3, even when the screw-holding tape is suddenly pulled down by an external force, the auxiliary spring exerts a force in the direction opposite to the direction of the two-arm lever being pivotally moved by such an external force, and therefore, any sudden pivotal movement of the two-arm lever during stoppage of the device can be more surely prevented.

The construction of the tape-pulling back mechanism as enables the tape to be freely pulled back by an operation of a lever, and therefore, the tape can be replaced by a screw-holding tape with a different type of screws during operation as occasion demands.

The construction of a screw guide mechanism allows any long screws, which could not be used in any prior art screw holding devices, as well as any short screws to be held so that the axis of the screws are not offset from the axis of the screwdriver, and accordingly, the screws can precisely be driven into predetermined positions.

The construction of the screw holding mechanism has a wide range of angles of pivotal motion to guide the tape as compared with that in the prior art, and enables the tape to be smoothly fed.

It is understood by those skilled in the art that the foregoing descriptions are preferred embodiments of the disclosed device and that various changes and modifications may be made in the invention without departing from the spirit and scope thereof.

What is claimed is:

1. A screw-driving device which is adapted to be coupled to a screwdriver and continuously drive screws held in a screw-holding tape in line one by one during a pressure stroke, which comprises:

a tubular casing coupled to said screwdriver;

a slide member slidably fitted for reciprocating movement in said casing;

a return spring means for returning said slide member to its initial extended position during a return stroke;

a mechanism provided in said slide member for feeding said screw-holding tape by one-step pitches corresponding to the distances between the adjacent screws on said tape, said screw-holding tape-feeding mechanism including:

a guide slot means provided in said casing;

a two-arm lever means having a pin fitted into said guide slot at the end of one arm of said two-arm lever and pivotally connected to said slide member;

a pawl member pivotally connected to the end of the other arm of said two-arm lever and engageable in one of grooves or apertures at one lateral edge of said screw-holding tape by a spring means; and a further pawl member pivotally connected to said slide member and engageable in one of further grooves or apertures at one lateral edge or the opposite lateral edge of the screw-holding tape by a spring means, said guide slot means including an inclined section which causes said two-arm lever means to be pivotally moved so that said pawl member of said two-arm lever is returned over said screw-holding tape held by said further pawl member by one pitch during said pressure stroke and feeds said screw-holding tape by one pitch during said return stroke.

2. A screw-driving device as claimed in claim 1, wherein said guide slot including a short rectilinear section in front of said inclined section thereof extending continuously therewith in the longitudinal direction of said casing, whereby said pin at the end of one arm of said two-arm lever is fitted into said short rectilinear section in the position of stoppage of the device where said slide member is extended out of said casing to the maximum by said return spring means.

3. A screw-driving device as claimed in claim 1, further including an auxiliary spring means for biasing said two-arm lever in the direction opposite the direction of said two-arm lever being pivotally moved when said pin at the end of one arm of said two-arm lever is moved along said inclined section of said guide slot during said pressure stroke.

4. A screw-driving device as claimed in claim 1, further comprising a mechanism provided in said slide member for pulling back said screw-holding tape in the direction opposite the tape-feeding direction, said tape pulling-back mechanism including projections extending toward each other and provided on both said pawl member pivotally connected to said two-arm lever and said further pawl member pivotally connected to said slide member at the ends of both said pawl members away from the pawls thereof, and a two-arm lever pivotally connected to said slide member and adapted to engage said opposite projections for pulling back said pawls of both pawl members in the direction away from the groove or aperture of the screw-holding tape.

5. A screw-driving device as claimed in claim 1, further comprising a screw holding mechanism provided in front of a tape guide passage of said slide member, said screw-holding mechanism including a pair of screw guide members slidably arranged opposite each other with the axis of said screwdriver as a center, and in a transverse through-hole of said slide member passed through transversely to the tape feeding direction, spring means for biasing said screw guide members normally in such a direction as to be moved toward each other, and a means for moving said pair of screw guide members toward and away from each other at the time of driving the screws and at the time of feeding the tape, respectively, while being linked to the movement of the screw-holding tape by one-step pitches.

6. A screw-driving device as claimed in claim 5, wherein said means for moving a pair of screw guide members toward and away from each other at the time of driving the screws and at the time of feeding the tape, respectively, while being linked to the movement of the screw-holding tape by the step of one pitch, comprises, in the case where the tape has the grooves opening outwardly along both lateral edges thereof at equal pitches, tape-linked levers each pivotally connected at one end thereof to said screw guide member, said tape-linked levers each extending from the screw holding center line of said screw guide members in the tape feeding direction and pivotally connected at the other end thereof to said slide member, and V-shaped projections each provided on each tape-linked lever at a position offset from the screw holding center line of said screw holding member by half the one pitch of said grooves so that said V-shaped projections are fitted into the grooves of the tape when said one pair of screw guide members engage each other.

7. A screw-driving device as claimed in claim 5, wherein said means for moving a pair of screw guide members toward and away from each other at the time of driving the screws and at the time of feeding the tape, respectively, while being linked to the movement of the screw-holding tape by the step of one pitch, comprises, in the case where the tape has the apertures along both lateral edges thereof at equal pitches, guide member-holding levers each pivotally connected at one end thereof to each of said screw guide members, said guide member holding levers each extending from the screw holding center line of said guide members in the tape feeding direction and pivotally connected at the other end to said slide member, tape-linked two-arm levers pivotally connected to said slide member outwardly of both lateral edges of the tape so that the end of one arm of each of said levers engages a drive slot provided on each of said guide member-holding levers and the end of the other arm thereof fits into and out of the aperture of the tape in the direction perpendicular to the surface of the tape, said end of the other arm of each of said tape-linked two-arm levers being at a position offset from the screw-holding center line of said screw guide members by half the one pitch of said tape apertures so that it fits into the said tape aperture when said one pair of screw guide members engage each other.

8. A screw-driving device as claimed in claim 1, further comprising a tape-holding means provided on the back portion of the side of said casing at the side of said slide member provided with a tape inserting opening, said tape holding means including a mount secured to the back portion of said casing and a tape holding member pivotably supported by a pivotal shaft secured to said mount in a manner parallel to the plane of said casing, said tape-holding member being supported on said pivotal shaft so that the guide groove thereof is inclined obliquely and upwardly toward the tape-inserting opening of said slide member.

* * * * *